United States Patent [19]

Nealy

[11] 4,041,562

[45] Aug. 16, 1977

[54] SURFBOARD LEASH

[76] Inventor: Robert B. Nealy, 129 Ladera Lane, San Clemente, Calif. 92672

[21] Appl. No.: 679,731

[22] Filed: Apr. 23, 1976

[51] Int. Cl.[2] ..... A63C 15/06

[52] U.S. Cl. ..... 9/310 AA; 24/3 A

[58] Field of Search ..... 9/310 R, 310 A, 310 AA, 9/310 B, 310 E, 310 F, 310 G, 310 H, 310 J, 301, 304, 307, 308, 309, 311; 24/3 A, DIG. 18, 245 RL, 266, 265 R, 265 CC, 265 BC; 224/28 R, 28 A

[56] References Cited

U.S. PATENT DOCUMENTS

| | | | |
|---|---|---|---|
| 1,971,844 | 8/1934 | Babbitt | 9/307 |
| 3,109,186 | 11/1963 | Glenn | 9/309 |
| 3,372,438 | 3/1968 | Rinecker | 24/DIG. 18 |
| 3,802,011 | 4/1974 | Castagnola | 9/310 E |
| 3,931,656 | 1/1976 | Thomson | 9/310 E |

FOREIGN PATENT DOCUMENTS

| | | | |
|---|---|---|---|
| 2,319,887 | 4/1973 | Germany | 24/DIG. 18 |
| 791,983 | 3/1958 | United Kingdom | 224/28 R |

*Primary Examiner*—Trygve M. Blix
*Assistant Examiner*—Jesus D. Sotelo
*Attorney, Agent, or Firm*—Martin A. Voet

[57] ABSTRACT

A surfboard leash comprising an ankle attachment and a resilient cord attached at one end to a surfboard and at the other end to the ankle attachment. The ankle attachment includes a flexible strap having first and second ends and a buckle having at least one opening extending therethrough. One end of the strap is attached to the buckle, and the other end of the strap is adapted to be passed through the opening in the buckle, folded back on itself, and releasably attached to another region of the strap by a quick release fastener.

7 Claims, 10 Drawing Figures

SURFBOARD LEASH

BACKGROUND OF THE INVENTION

When surfing, it is common practice to use a surfboard leash to attach the surfboard to the ankle of the surfer. Thus, when the surfer leaves his board after riding a wave, the board cannot be carried by the surf onto the beach. This eliminates the need for the surfer to swim to the beach to retrieve his surfboard and prevents the surfboard from being damaged by being driven against rocks or other obstacles near the beach.

One prior art surfboard leash is shown in U.S. Pat. No. 3,802,011. This leash includes a resilient cord attached at one end to an ankle attachment and at the other end to the surfboard. One problem with this construction is that the ankle attachment is positively held in a closed position only when the resilient cord is tensioned. Conversely, with the cord under tension, the ankle attachment is difficult to remove thereby increasing the likelihood that it will be difficult to quickly remove in an emergency. In other words, the opening and positive closing of the ankle attachment is subject to factors which are not under the surfer's control.

It is also known to use an ankle attachment which includes a flexible strap and Velcro to releasably hold the strap closed. The Velcro is convenient to release, but also may unintentionally and prematurely release when placed under stress during normal use.

SUMMARY OF THE INVENTION

The present invention provides a surfboard leash which generally overcomes the disadvantages noted above. With the present invention, the ankle attachment includes a flexible strap, a buckle attached to the strap, and quick release fastener means which cooperate to positively hold the ankle attachment in a loop around the user's ankle. The quick release fastener means can be quickly released to allow intentional release and removal of the ankle attachment.

The buckle is attached to the strap at a location along the strap spaced from one end of the strap. The buckle has an opening, and a first region of the strap spaced from the buckle can be extended through the opening to form the ankle attachment into a loop. The first region can then be folded back over a second region of the strap and releasably attached to such second region by the quick release fastener means. The buckle strengthens the closure of the ankle attachment so that unintentional release of the ankle attachment as experienced in the prior art is eliminated.

The buckle and strap can cooperate in various ways to form the ankle attachment into a loop. However, the use of quick release fastener means to attach the two regions of the strap together is preferred because this facilitates rapid removal of the ankle attachment in the water.

The quick release fastener means can take many different forms and may include Velcro. The soft material and the hooks of the Velcro are attached to the same face of the strap so that when the first region of the strap is folded back over the second, the hooks can contact the soft material.

The resilient cord or element is preferably attached to the ankle attachment adjacent the buckle. In a preferred embodiment, the attachment is directly to the buckle, and in another embodiment, the attachment is made to the strap near the buckle. If the attachment is made to the buckle, it is desirable to balance the forces on the buckle from the resilient cord, and this can be accomplished by locating the attachment centrally of the buckle.

The invention can best be understood by reference to the following description taken in connection with the accompanying illustrative drawing.

DESCRIPTION OF THE PREFERRED EMBODIMENTS

Figure 1:
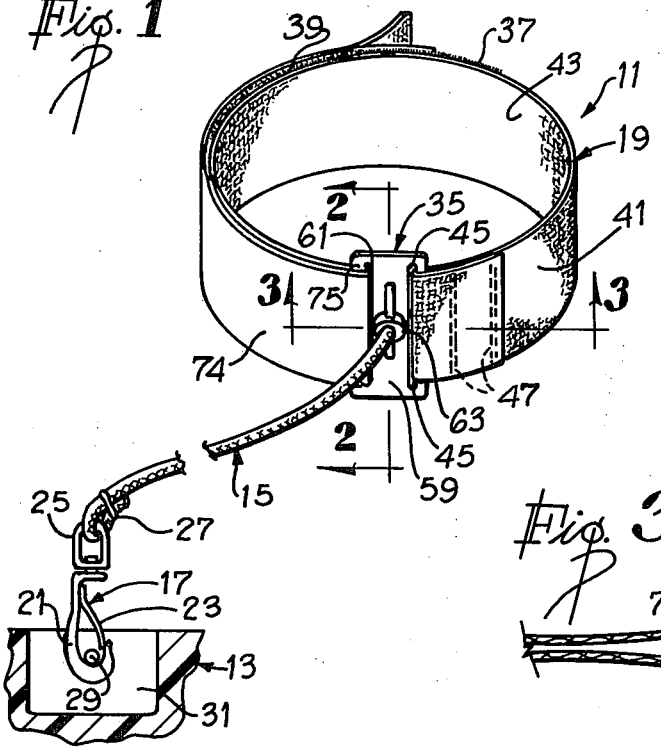
FIG. 1 is a perspective view of a surfboard leash attached to a surfboard with only a fragment of the surfboard being illustrated.

FIG. 1 shows a surfboard leash 11 attached to a surfboard 13. The leash 11 can be used with any kind of surfboard, and for this reason, the surfboard 13 is not shown in detail.

The surfboard leash 11 includes an elongated, flexible, resilient element in the form of a resilient cord 15, connector means 17 for attaching one end of the cord to the surfboard, and an ankle attachment 19. The cord 15 must be flexible and of sufficient strength not to break in normal use of the leash 11. To reduce shock on the ankle of the surfer, the cord 15 is preferably resilient. Any kind of elongated, flexible, resilient element of this type which is suitable for use in salt water can be utilized.

In the embodiment illustrated, the cord 15 includes an inner cord 16 of substantially nonelastic material such as nylon and an outer sheath 18 in the form of a tube and constructed of resilient material such as rubber. An excess amount of the inner cord 16 is provided so that the resilience of the outer sheath 18 will provide the entire cord 15 with a resilient characteristic in the axial direction.

For reasons discussed hereinbelow, means are provided for attaching a region of the outer sheath 18 to an adjacent region of the inner cord 16. Although the attaching means can take many different forms, in the embodiment illustrated, it includes a wire clamp 20 wound around and circumferentially compressing the outer sheath 18. In addition, the inner cord 16 is tied into a knot 22 immediately axially outwardly of the clamp 20. This prevents the inner cord 16 from being pulled to the right (as viewed in FIG. 2) relative to the outer sheath 18. The clamp 20 is preferably located closely adjacent; e.g., within a few inches of the ankle attachment 19.

The connector means 17 can be of any type which will releasably attach the cord 15 to the surfboard 13. In the embodiment illustrated, the connector means 17 includes a rigid hook 21 and a movable resilient arm 23 mounted on the hook 23. The hook 21 is suitably connected to the resilient cord 15 as by a swivel 25 which allows rotation of the hook relative to the cord. The cord 15 is passed through an opening in the swivel 25, folded back on itself, and clamped by a wire clamp 27. The connector means 17 can be attached to any suitable structure of the surfboard 13 such as a rod 29 suitably mounted in a well 31 of the surfboard.

Figure 1A:
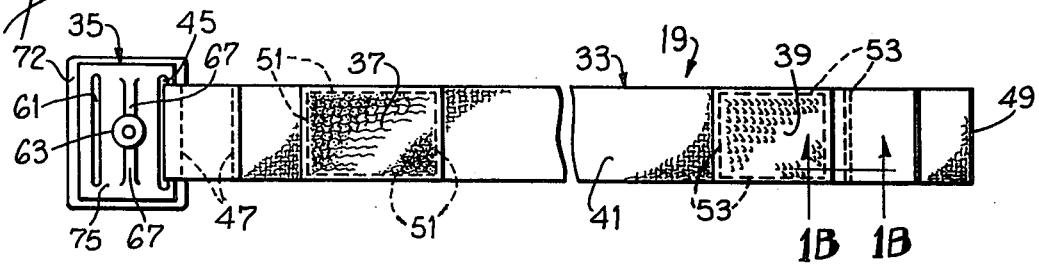
FIG. 1*a* is a plan view of the ankle attachment laid out in a flat condition.
Figure 1B:
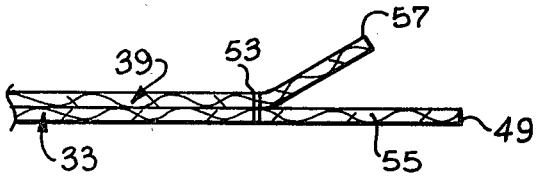
FIG. 1*b* is an enlarged, fragmentary sectional view taken generally along line 1*b*—1*b* of FIG. 1*a*.

As shown in FIGS. 1 and 1*a,* the ankle attachment 19 includes an elongated flexible strap 33, a buckle 35, and a quick release fastener means in the form of sheets or layers 37 and 39 of Velcro material. The strap 33 may be constructed of any strong flexible material such as a suitable woven fabric. The strap 33 has an outer face 41 and an inner face 43. One end of the strap 33 passes through an opening in the form of a slot 45 in the buckle 35, is folded back over itself and is stitched to another region of the strap along seams 47 to thereby attach this end of the strap to the buckle. Of course, other means may be utilized to attach the strap 33 to the buckle 35. The strap 33 also has a free end 49 remote from the buckle 35.

The layers 37 and 39 are suitably attached to the strap 33 in any suitable manner such as by stitching which extends along seams 51 and 53, respectively. Both of the layers 37 and 39 are provided on the outer face 41, and in the embodiment illustrated, the layers are spaced apart and located adjacent the opposite ends of the strap 33. The layer 37 is of soft material and the layer 39 contains the usual Velcro hooks; however, the layers 37 and 39 could contain the hooks and soft material, respectively, if desired. The seam 53 is spaced inwardly from the free end 49 to define tabs 55 and 57 on the strap 33 and the layer 39, respectively. The tabs 55 and 57 facilitate manual removal of the ankle attachment 19 from the ankle of the user.

Figure 2:
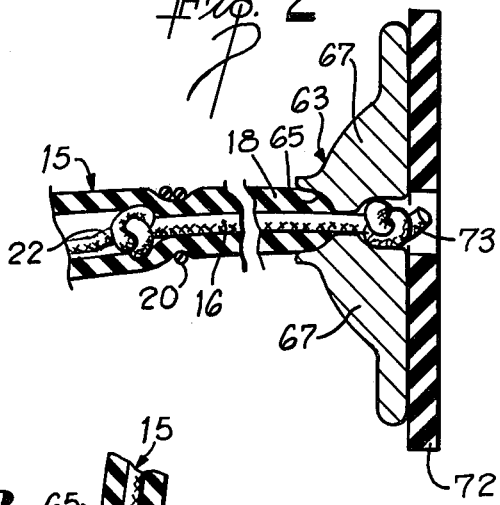
FIG. 2 is an enlarged sectional view taken generally along the line 2—2 of FIG. 1.
Figure 3:
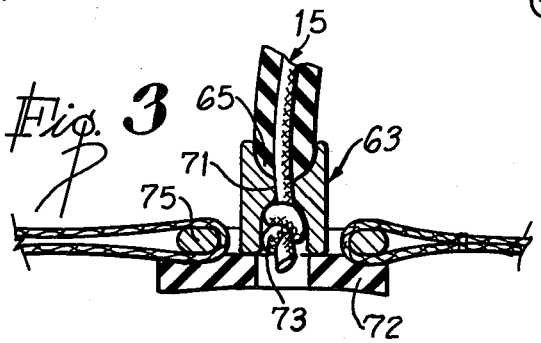
FIG. 3 is an enlarged fragmentary sectional view taken generally along line 3—3 of FIG. 1.

The buckle 35 can take many different forms; however, the form shown in FIGS. 1–3 is preferred. The buckle 35 can be constructed of any strong material such as metal or a strong, rigid or pliable plastic material e.g. nylong. The buckle 35 includes a plate 59 which contains the slot 45 and another opening in the form of a slot 61. A boss 63 having an aperture or axial passage 65 extending therethrough is suitably mounted on a central region of the plate 59. The axis of the boss 63 is perpendicular to the plate 59. The boss 63 is reinforced by webs 67 on the opposite sides of the boss 63. Thus, the boss 63 lies intermediate the slots 45 and 61.

The boss 63 has an annular restriction or flange 71 which reduces the diameter of a central region of the passage 65. As shown in FIGS. 2 and 3, the inner cord 16 extends into the passage 65 and has an enlargement in the form of a knot 73 of sufficient size to prevent withdrawal of the resilient cord from the passage 65. A soft resilient pad 72 of rubber or other suitable material is suitably attached as by an adhesive to the back of the buckle 35.

In use, a first region 74 (FIG. 1) of the strap 33, which includes the free end 49 is inserted through the slot 61 to form the ankle attachment into a loop. The first region 74 is then folded back over a bar portion 75 of the buckle 35. The layer 39 of hooks is then pressed into the layer 37 of soft material to releasably retain the first region against the loop.

In the embodiment of FIG. 1, all of the forces exerted by the surfboard 13 against the ankle attachment 19 are applied directly to a central region of the buckle 35. The layer 37 and 39 of Velcro have sufficient holding power because of the presence of the buckle 35 to avoid unintentional opening of the ankle attachment 19. Adjustability for various ankle sizes is obtained by the degree to which the free end 49 is pulled through the slot 61. The cord 15 can be conveniently removed from the buckle 35 by untying knot 73. The pad 72 extends beyond the edges of the buckle 35 to protect the surfer's ankle from being injured by the buckle 35.

It is important that the cord 15 be prevented from getting beneath the feet of the surfer. This desirable result is achieved with the present invention by the boss 63 which directs the cord 15 away from the surfer's ankle. In addition, the clamp 20 and the know 22 (FIG. 2) cooperate to assure that the end portion of the outer sheath 18 is held within the passage 65. Specifically, the clamp 20 and the knot 22 prevent the outer sheath 18 from moving to the left (as viewed in FIG. 2) relative to the inner cord 18. Thus, the boss 63, the clamp 20, and the knot 22 cooperate to assure that the cord 15 will be directed away from the surfer's ankle.

Figure 4:
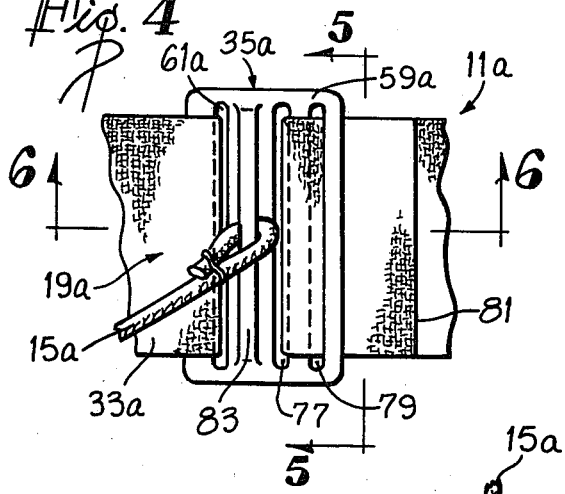
FIG. 4 is a fragmentary plan view of a second embodiment of the surfboard leash constructed in accordance with the teachings of this invention.
Figure 5:
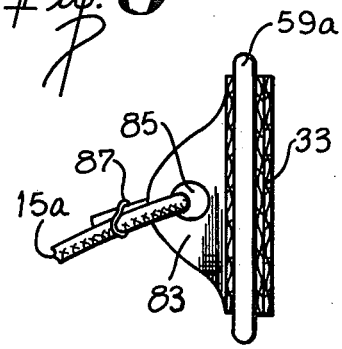
FIG. 5 is a sectional view taken generally along line 5—5 of FIG. 6.
Figure 6:
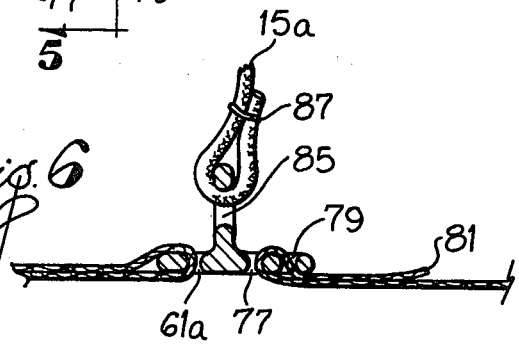
FIG. 6 is a fragmentary sectional view taken generally along line 6—6 of FIG. 4.

The FIGS. 4–6 show a surfboard leash 11*a* which is identical to the surfboard leash 11 in all respects not shown or described herein. Portions of the surfboard leash 11*a* corresponding to portions of the surfboard leash 11 are designated by corresponding reference numerals followed by the letter "*a.*"

The primary difference between the surfboard leash 11*a* and the surfboard leash 11 is in the construction of the buckle 35*a.* In the buckle 35*a,* the slot 45 is replaced by two slots 77 and 79. The strap 33*a* has a second free end 81 which is inserted up through the slot 77 and back down through the slot 79 to permit the size of the ankle attachment 19*a* to be adjusted. Once adjusted, the forces of friction between the buckle 35*a* and the strap 33 adjacent the free end 81 hold the strap and buckle against sliding movement.

The buckle 35*a* has a flange or member 83 which extends generally perpendicular to the plate 59*a.* The flange 83 is intermediate the slot 61*a* and the slot 77 and is located generally centrally on the plate 59*a.* The flange 83 has an aperture 85 through which the resilient cord 15*a* extends to permit attachment of the cord to the flange in any suitable manner such as by a wire clamp 87.

The surfboard leash 11*a* includes quick release fastener means which may be identical to the layers 37 and 39 of Velcro shown in FIGS. 1–3. However, the length of the layers 37 and 39 may be reduced in the embodiment of FIGS. 4–6 because size adjustment of the ankle attachment 19*a* is obtained with the slots 77 and 79. Accordingly, a savings in material can be realized. Except for the manner in which the size of the ankle attachment 19*a* is adjusted, the surfboard leash 11*a* can be used in the same manner described above with reference to FIGS. 1–3.

Figure 7:
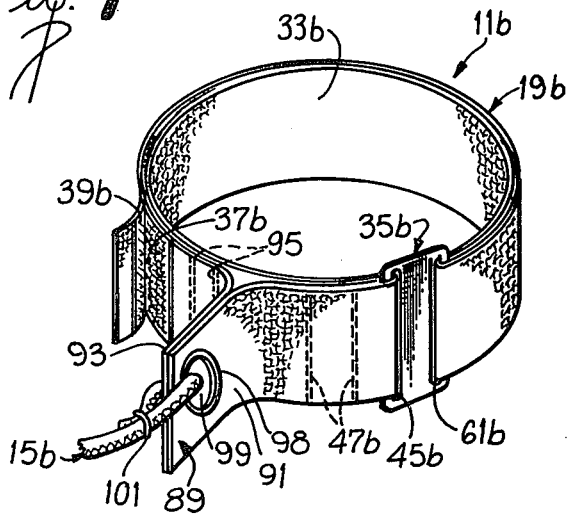
FIG. 7 is a perspective view of a third embodiment of the surfboard leash constructed in accordance with the teachings of this invention.

FIG. 7 shows a surfboard leash 11*b* which is identical to the surfboard leash 11 in all respects not shown or described herein. Portions of the surfboard leash 11 are designated by corresponding reference numerals followed by the letter *b.*

The primary difference between the surfboard leash 11*b* and the surfboard leash 11 is that the resilient cord 15*b* is not attached directly to the buckle 35*b*. Accordingly, the buckle 35*b* does not have the boss 63 and the supporting webs 67.

The resilient cord 15*b* is attached directly to a tab 89 of the strap 33*b* closely adjacent the buckle 35*b*. In the embodiment illustrated, the tab 89 includes an extension 91 of the strap 33*b* beyond the seams 47*b* and a strip 93 of a suitable fabric attached to the other portions of the strap 33*b* by stitches along seams 95.

The tab 89 includes a metal grommet 98 defining an aperture 99 through which the resilient cord 15*b* extends. The cord 15*b* is attached to the tab 89 by a clamp 101.

The surfboard leash 11*b* can be used in the same manner as the surfboard leash 11. Although the resilient cord is not attached directly to the buckle 35*b*, it is attached to the strap 33*b* adjacent the buckle. This allows the buckle 35*b* to cooperate with the layers 37*b* and 39*b* of Velcro to firmly and positively hold the ankle attachment 19*b* in the closed position.

Figure 8:
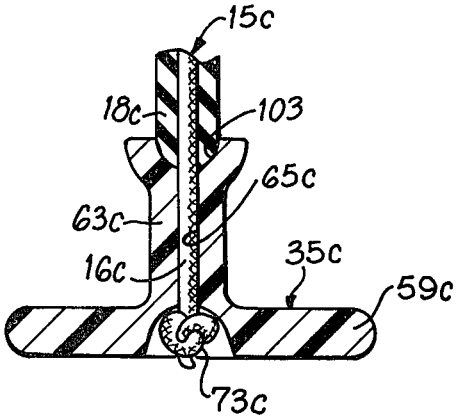
FIG. 8 is a sectional view similar to FIG. 2 of another form of buckle which can be used with the surfboard leashes of FIGS. 1–6.

FIG. 8 shows a buckle 35*c* which can be used in the same manner described hereinabove as the buckle (FIGS. 1–3). Except as specifically shown or described herein, the buckle 35*c* may be identical to the buckle 35. Portions of the construction shown in FIG. 8 corresponding to portions of the construction shown in FIGS. 1–3 are designated by corresponding reference numerals followed by the letter "*c*."

The buckle 35*c* includes a plate 59*c* and a boss 63*c* having an aperture or an axial passage 65*c* extending therethrough. The axis of the boss 63*c* is perpendicular to the plate 59*c*. The passage 65*c* has an outer enlarged portion 103 for receiving an end portion of the outer sheath 18*c*, which outer end portion is retained within the enlarged portion 103 in the same manner described hereinabove with reference to FIGS. 1–3. The inner cord 16*c* extends into the passage 65*c* and has an enlargement in the form of a knot 73*c* of sufficient size to prevent withdrawal of the resilient cord from the passage.

To reduce the torque on the buckle 35*c* while retaining the advantages of the boss 63*c*, the boss is made resiliently flexible. This may be accomplished, for example, by integrally molding the entire buckle 35*c* from a flexible, resilient material such as polyurethane. Alternatively, the plate 59*c* may be constructed of a rigid material, such as metal or plastic, and the boss 63*c* can be constructed of a suitable resilient material.

The buckle 35*c* can be incorporated into a surfboard leash in the same manner as the buckle 35 (FIGS. 1–3).

Many of the features illustrated with respect to only one embodiment of this invention, are applicable to many different embodiments of the invention. For example, the resilient pad 72 can be used to provide a soft cushion or base for any of the embodiments of this invention. Similarly, the strap and buckle adjustment feature of FIGS. 4–6 can be applied, for example to the embodiment of FIGS. 1–3.

Although exemplary embodiments of the invention have been shown and described, many modifications and substitutions may be made without necessarily departing from the spirit and scope of this invention.

I claim:

1. A surfboard leash comprising:

an ankle attachment including a flexible strap adapted to be wrapped around the ankle of the user, said strap having first and second ends and first and second generally opposite faces;

said ankle attachment including a buckle having at least one opening extending therethrough and means for connecting the buckle to the strap at a location along said strap which is spaced from said first end, a first region of said strap spaced from said location being extendable through the opening of the buckle to form the ankle attachment into a loop;

said ankle attachment including quick release fastener means for releasably attaching said first region of the strap to a second region of the strap whereby the quick release fastener means can releasably hold the ankle attachment in said loop;

an elongated, flexible, resilient element attachable to the surfboard; and a boss on said buckle for attaching the resilient element to the ankle attachment, said boss having a passage extending therethrough, said resilient element extends into said passage from one end thereof, and said surfboard leash includes means for preventing withdrawal of the resilient element from said passage.

2. A surfboard leash as defined in claim 1 wherein said buckle includes a plate-like member, said boss is centrally located on said plate-like member, said opening includes a first slot on one side of said boss and said buckle connecting means includes a second slot on the other side of the boss, and said strap extends into the second slot.

3. A surfboard leash as defined in claim 1 including a resilient pad on one side of said buckle.

4. A surfboard leash as defined in claim 1 wherein at least a portion of said boss is resiliently flexible.

5. A surfboard leash as defined in claim 1 wherein said resilient element includes an inner cord and an outer sheath, and said surfboard leash includes means for holding a portion of said sheath in said passage.

6. A surfboard leash as defined in claim 1 wherein said holding means includes means for attaching a region of said sheath spaced from said boss to an adjacent region of said inner cord, said cord being substantially nonelastic and said sheath being resilient.

7. A surfboard leash as defined in claim 1 wherein said boss includes a restriction in said passage, said resilient element extends beyond said restriction, and said attaching means includes an enlargement on said resilient element of sufficient size to prevent withdrawal of said resilient element from the passage.

* * * * *